US006260618B1

(12) United States Patent
Davis et al.

(10) Patent No.: US 6,260,618 B1
(45) Date of Patent: Jul. 17, 2001

(54) METHOD FOR LOCATING PLACEMENT OF A GUIDE STOCK IN A MULTILATERAL WELL

(75) Inventors: John P. Davis, Cypress; Jim H. Roddy, Houston; Edward T. Wood, Kingwood, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/199,688

(22) Filed: Nov. 25, 1998

Related U.S. Application Data

(60) Provisional application No. 60/066,607, filed on Nov. 26, 1997.

(51) Int. Cl.[7] ..... E21B 47/09

(52) U.S. Cl. ..... 166/250.09; 166/255.1; 166/255.2; 166/255.3; 73/152.59; 73/152.17

(58) Field of Search ..... 166/250.09, 255.1, 166/255.2, 255.3, 250.17; 73/152.17, 152.59

(56) References Cited

U.S. PATENT DOCUMENTS

| | | | |
|---|---|---|---|
| 2,942,669 | | 6/1960 | Mounce et al. . |
| 3,070,166 | | 12/1962 | Knauth . |
| 3,575,237 | | 4/1971 | Malone . |
| 3,750,750 | | 8/1973 | Urbanosky . |
| 3,855,854 | | 12/1974 | Hutchison et al. . |
| 3,855,855 | | 12/1974 | Hutchinson et al. . |
| 3,855,856 | | 12/1974 | Hutchison et al. . |
| 3,905,227 | | 9/1975 | Kinley . |
| 3,918,520 | * | 11/1975 | Hutchison ..... 166/64 |
| 3,963,654 | | 6/1976 | Hutchison et al. . |
| 4,124,547 | | 11/1978 | Hutchison et al. . |
| 4,415,205 | | 11/1983 | Rehm et al. . |
| 4,573,541 | | 3/1986 | Josse et al. . |
| 4,616,987 | | 10/1986 | Boyers et al. . |
| 4,742,871 | | 5/1988 | Miffre . |
| 5,301,760 | | 4/1994 | Graham . |
| 5,311,936 | | 5/1994 | McNair et al. . |
| 5,318,121 | | 6/1994 | Brockman et al. . |
| 5,318,122 | | 6/1994 | Murray et al. . |
| 5,322,127 | | 6/1994 | McNair et al. . |
| 5,325,924 | | 7/1994 | Bangert et al. . |
| 5,330,007 | | 7/1994 | Collins et al. . |
| 5,337,808 | | 8/1994 | Graham . |
| 5,353,876 | | 10/1994 | Curington et al. . |
| 5,388,648 | | 2/1995 | Jordan, Jr. . |
| 5,533,573 | | 7/1996 | Jordan, Jr. et al. . |
| 5,651,415 | | 7/1997 | Scales . |
| 5,697,445 | | 12/1997 | Graham . |
| 5,715,891 | | 2/1998 | Graham . |

OTHER PUBLICATIONS

Lynes Technical Manual, Feb. 4, 1977.

* cited by examiner

*Primary Examiner*—Eileen D. Lillis
*Assistant Examiner*—Sunil Singh
(74) *Attorney, Agent, or Firm*—Cantor Colburn LLP

(57) ABSTRACT

A method for locating placement of a guide stock in a multilateral well wherein the guide stock is properly aligned with the lateral borehole. The method employs an impression packer with a scribed reference line to provide information at the surface regarding the lateral borehole's exact location and orientation with respect to the originally installed whipstock packer. This information is then employed to make up a guide stock and orientation sub to properly orient the diverter face of the guide stock with the lateral borehole. There are tool embodiments for inflating the impression packer to a preset relatively low internal pressure. In one embodiment, the inflation fluid is carried downhole in the tool and is released to the packer on set down pressure, the fluid being drawn back out of the packer upon pick up. In another embodiment, the impression packer is outfitted with an automatically closing valve. The valve can be mechanically electromechanically or electrically activated and may work in combination with a controller.

6 Claims, 10 Drawing Sheets

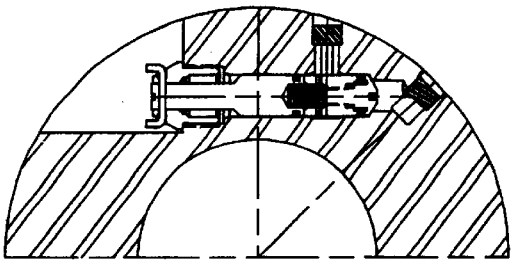
FIG. 24A1
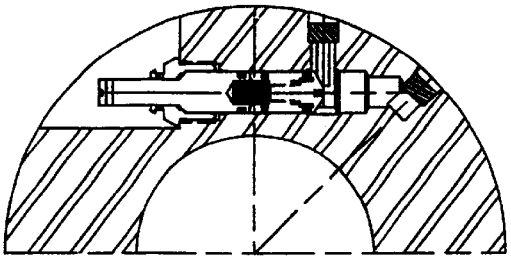
FIG. 24A2
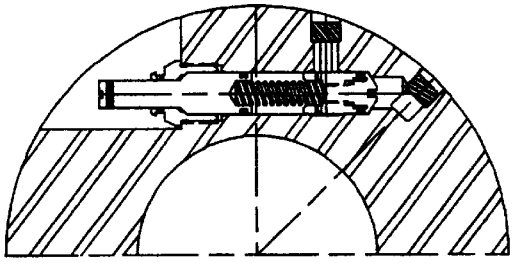
FIG. 24A3
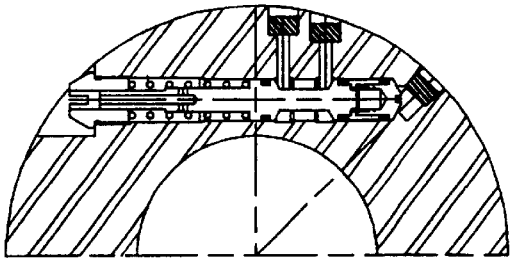
FIG. 24B1
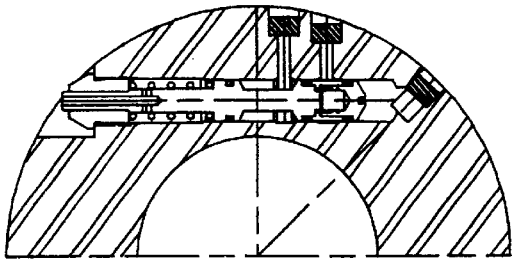
FIG. 24B2

METHOD FOR LOCATING PLACEMENT OF A GUIDE STOCK IN A MULTILATERAL WELL

CROSS REFERENCE TO RELATED APPLICATIONS

This application claims the benefit of an earlier filing date from U.S. Provisional Application Ser. No. 60/066,607, filed Nov. 26, 1997.

BACKGROUND OF THE INVENTION

1. Field of the Invention

The invention relates to oil well tools. More particularly the invention relates to proper placement of a guide stock in a wellbore for diverting tools into a lateral borehole.

2. Prior Art

When a lateral borehole is to be drilled a certain sequence of events is known and practiced regularly. First a packer is set within a primary wellbore at a location downhole of the desired exit point for a lateral borehole. A whipstock is then run and inserted in the anchor, the whipstock having an orientation sub thereon which orients the face of the whipstock in the desired direction of the proposed lateral borehole. A drill is run and the lateral borehole created. The drill is removed, the whipstock is removed and a guide stock is stabbed into the original packer. Since the guide stock is provided with the same type of orientation sub it orients in the same direction that the whipstock originally did. This is an old and well-known sequence of events and would seem to indicate that the diverter face of the guide stock should be aligned with the lateral borehole. Unfortunately, however, during the kicking off of the drill from the whipstock, the whipstock tends to move due to the tremendous torque placed on the whipstock by the drill. Since the whipstock is in this (contorted to some degree) condition when the drill leaves the primary bore the exact angle and orientation of the window thereby created is somewhat different than planned. The movement does not translate to the packer and so when the whipstock is replaced by a guide stock for feeding other tools into the lateral borehole, it may not be aligned. The orientation of the guide stock, not having any torque loads thereon is that of what was originally planned and may not coincide with the actual orientation of the lateral borehole itself. For this reason it has always been challenging to properly orient the guide stock to align with the lateral borehole.

Prior art methods for aligning the guide stock include, as the most common and ubiquitous method, experience of the drill team. More specifically, upon removing the whipstock from the hole an inspection is made which to a skilled and experienced eye will indicate about how far off the planned orientation the lateral borehole has been drilled. This is accomplished by examining marks made on the whipstock by the drill bit such as how deep the marks are, where on the diverter face the marks are located, etc. These marks tell the experienced driller where the bit bound and kicked off the whipstock diverter face and thus in which direction drilling began. From these determinations the drill team will reorient the guide stock by attaching the orientation sub to the guide stock differently. This modifies the orientation of the diverter surface so as to be more likely to be aligned with the lateral borehole. While skill and experience are of the most important assets in making a well work, the guestimate method of placing a guidestock leaves exactness to be desired.

SUMMARY OF THE INVENTION

The above-discussed and other drawbacks and deficiencies of the prior art are overcome or alleviated by the method and apparatus for placing a guide stock of the invention.

A guide stock can be reliably and precisely placed and aligned with respect to a lateral borehole by first obtaining an impression of the actual borehole window through the casing of the primary well including its exact orientation with an impression packer having an orientation sub attached thereto for engagement with the original packer installed in the primary well in preparation for drilling the lateral borehole. Upon inflation of the impression packer, the soft casing is urged into the lateral borehole opening and an impression of the window is recorded in the soft covering on the impression packer. The impression packer is then tripped out of the hole and can be reinflated at the surface to measure the impression of the lateral borehole. The impression is an exact duplicate showing angle, orientation, chord length, etc. of the window. Armed with this information a guide stock may be specifically tailored with an orientation sub and space-out subs to perfectly align with the lateral borehole. Enhancing the ability to measure the window impression is the act of scribing a line in the impression cover to employ as a reference.

In another aspect of the invention an impression packer having its own inflation reservoir is disclosed. While a standard impression packer known to the prior art may be employed in the method of the invention, certain inherent drawbacks exist. Although standard impression packers regularly function correctly, there are times when inflation is not completed or deflation is not possible. This is generally due to the employment of a rig pump at a great distance from the tool to inflate the tool and the length of the fluid column with respect to deflation. For preferred employment with the method of the invention is an impression packer having its own on-board inflation source.

The self-inflation impression packer of the invention provides more certainty that the packer will inflate to the desired pressure (approximately 200 psi) without significantly exceeding that pressure and will deflate reliably and without difficulty. The self-inflation device carries a predetermined quantity of inflation fluid which is urged into the element upon set down weight. The device automatically deflates the impression packer upon pick up. The arrangement avoids prior art inflation and deflation problems associated with pressuring up from the surface to deploy the packer. In another embodiment of the invention, the over pressure problem is avoided by installing a valve which closes at a specific predetermined pressure rating (e.g. 200 psi). A valving system is disclosed.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 24A-1 is a cross sectional view taken along section line A—A in FIG. 24;

FIG. 24A-2 is the section of FIG. 24A-1 but in an alternate position;

FIG. 24A-3 is the section of FIG. 24A-1 but in an alternate position;

FIG. 24B-1 is a cross sectional view taken along section line B—B in FIG. 24;

FIG. 24B-2 is the section of FIG. **24*b*-1** but in alternate position;

DETAILED DESCRIPTION OF THE PREFERRED EMBODIMENTS

Figure 1:
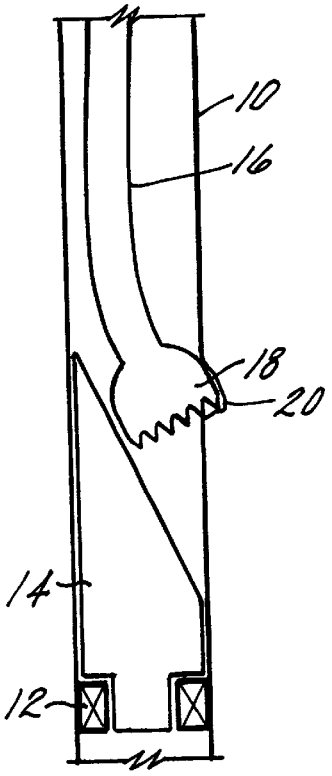
FIG. 1 is a cross sectional elevation view of a primary wellbore illustrated with a drill string being deflected by a whipstock to drill a lateral borehole.
Figure 2:
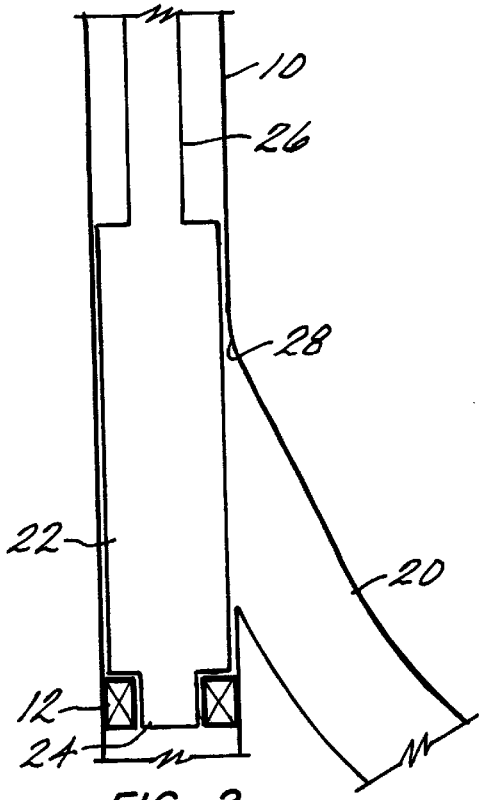
FIG. 2 is a cross sectional elevation view of the primary wellbore and lateral borehole with an impression packer installed therein.
Figure 3:
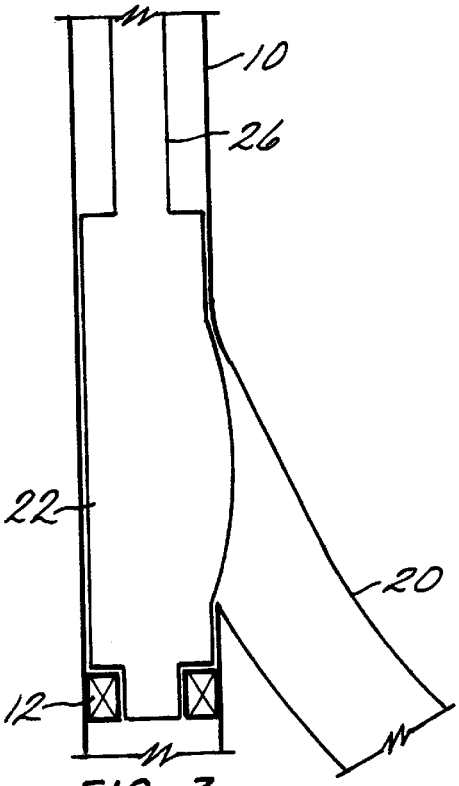
FIG. 3 is a cross sectional elevation view similar to FIG. 2 but with the impression packer inflated.
Figure 4:
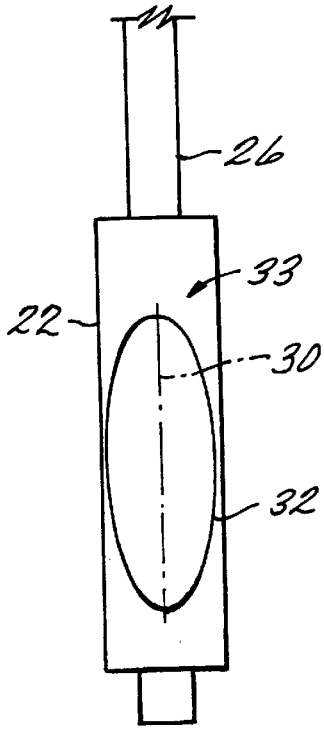
FIG. 4 is a view of the impression packer, removed from the wellbore and reinflated to provide a representation of the drilled window in the impression rubber.

Referring to FIG. 1 it becomes apparent why placement of a guide stock is a difficult matter. FIG. 1 represents a primary wellbore 10 to having a packer 12 installed therein for drilling of a lateral borehole. A whipstock 14 is installed in packer 12 as is conventionally known, until this point the relative orientation of the parts is known and is relatively precise. Upon introduction of the drill string 16 however, with drill bit 18, certainty of location and orientation is lost to some degree. Drill bits, as is known to those familiar with oil well drilling, are large and course as well as heavy and driven with incredible torque. Upon a drill bit 18 contacting the face of whipstock 14, it gouges the face and puts tremendous downward and lateral forces as well as torsional forces on the whipstock as bit 18 kicks off to drill a lateral borehole 20. These forces tend to distort and move whipstock 14 away from the precisely set orientation it had when installed since during drilling, the whipstock is not in the predetermined position, the lateral borehole is not being drilled precisely as it was intended to be. The degree of distortion is generally not substantial however it is sufficient to render a guide stock not properly aligned with the borehole 20. This can and does often make installing lateral tools difficult Referring to FIGS. 2, 3 and 4, the method of the invention allows the rigger to gather precise information about the location and orientation of the drilled lateral borehole 20. With this information a guide stock may be designed to align with borehole 20 exactly. The method of the invention may employ a conventional impression packer (commonly commercially available) or may employ impression packers of the invention which are disclosed in detail hereunder. In the method of the invention, prior to running impression packer 22, the packer 22 is inflated to a circumference matching the circumference of the borehole in which it will be deployed to take an impression. In this condition a straight line is scribed where the window is expected to be (i.e. aligned with the orientation sub) on the outside diameter of the impression rubber of the packer 22 preferably the line is also painted onto the packer for ease of visibility. This is a reference line that will be employed post impression to provide an accurate measurement of the window. The line is visible in FIG. 4. The line is preferred due to possible twisting of the packer during removal from the well. The impression packer 22, (conventional impression packers being currently commercially available from Baker Oil Tools Houston, Tex.), is first deflated and then run in the hole with an orientation sub 24 attached to the bottom thereof which is engageable with packer 12. The packer 22 will be conventionally run on tool string 26. Upon landing the impression packer 22 in the packer 12, packer 22 is inflated to a pressure in the range of from about 100 psi to about 300 psi and preferably to about 200 psi to urge the impression rubber of the packer 22 against the window 28 to create an impression in the impression rubber. It should be noted that the psi range of about 100 to about 300 with a preferred pressure of about 200 psi has been determined by the inventor hereof to create well-defined impressions of the window 28 without seriously damaging the packer 22. Those skilled in the art will note the dramatic reduction in pressure employed from conventional use of impression packers for their originally intended purpose. More specifically, impression packers were developed to acquire impressions of casing erosion and cracking or fissures in open holes and employ a preferred working pressure of about 1000 psi. Because the window 28 being courted in the present invention is vastly larger than the features previously sought by impression packer use, the pressure had to be significantly reduced to prevent destruction of the tool including possibly bursting the inflatable element into the lateral borehole 20. In the conventional impression packer embodiment of the invention pressure is regulated at the surface while in the new impression packers of the invention pressure is regulated downhole for more precision.

Returning to the method of the invention, packer 22 having been inflated to about 200 psi is locked off and allowed to hold pressure for a period of time of preferably at least 30 minutes. Although it is possible to obtain an impression in less than 30 minutes it is not advisable for if a viable impression is not retrieved, a significant amount of time and money will have been lost. At a time after about 30 minutes (preferably) from the time impression packer reaches about 200 psi, the packer is deflated by allowing the fluid supply to drain out of the inflatable element. Preferably about 30 minutes is allowed to drain off the conventional impression packer. Subsequent to drainage the packer 22 is removed from the well to be examined.

At the surface, packer 22 (see FIG. 4) is reinflated to a circumferential dimension equaling that of the hole in which it was set so that measurement can be made with the rubber of the inflatable element expanded to the same degree as it was when the element was inflated downhole. Preferably, and if the whipstock 14 did not move too much during drilling of the lateral borehole 20, the scribed line 30 will be close to the center axis of the impression 32 on the impression rubber 33. Measurements are taken, using line 30 as a reference, at approximately one foot increments to get an accurate set of dimensions of window 28. The dimensions and orientation of the impression provide information such as the outer periphery dimensions of the window, the orientation and the distance from the original packer 12 that the window begins. These measurements are used to make up a guide stock that will align with the window.

Figure 5:
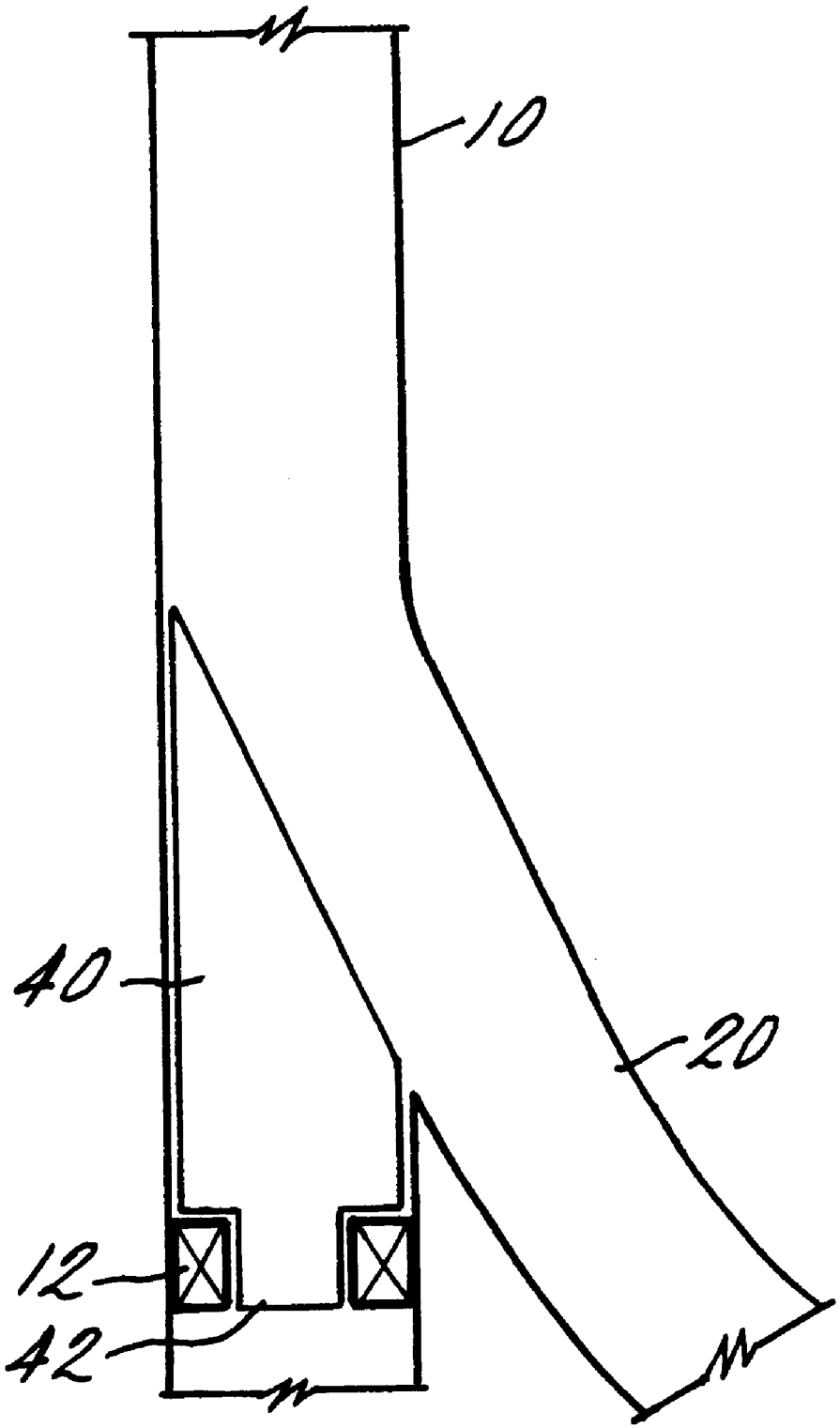
FIG. 5 is a cross sectional elevation view of the well with the guide stock installed.
Figure 6:
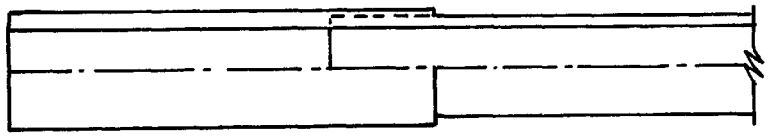
FIGS. 6–11 illustrate a cross sectional view of the valve assembly of the invention in an inflation tool;.
Figure 12:
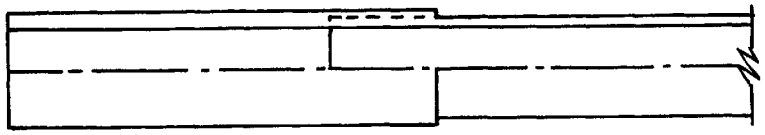
FIGS. 12–15 illustrate a cross sectional view of the valve assembly of the invention in an alternate position.
Figure 16:
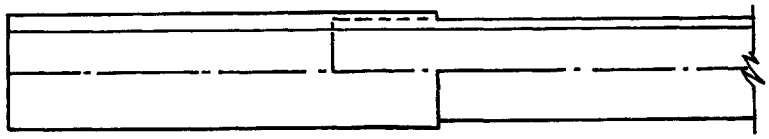
FIGS. 16–19 illustrate a cross sectional view of the valve assembly of the invention in an alternate position.
Figure 20:
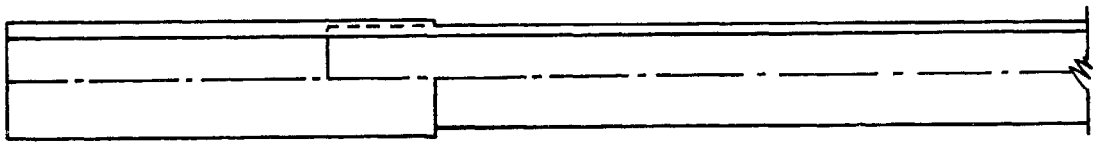
FIGS. 20–23 illustrate a cross sectional view of the valve assembly of the invention in another alternate position.
Figure 7:
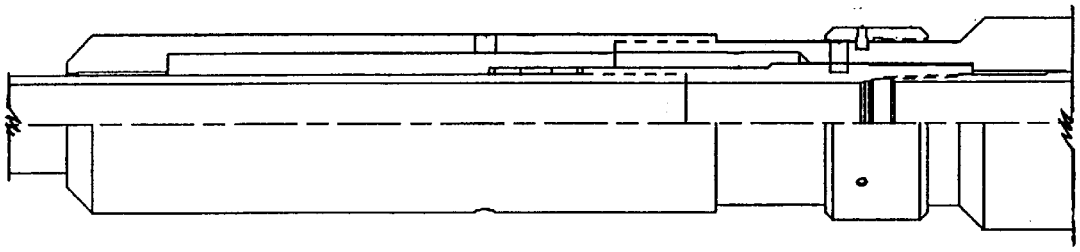
Figure 13:
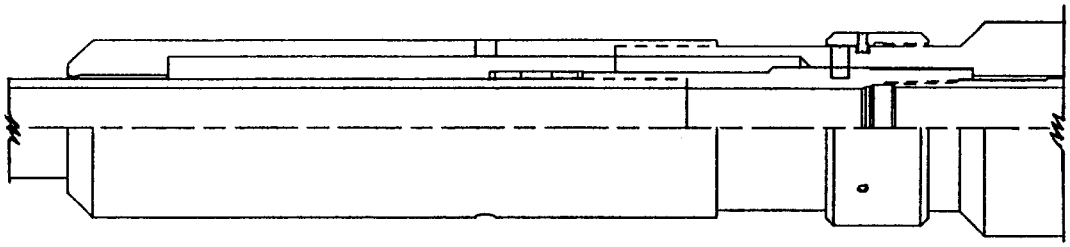
Figure 17:
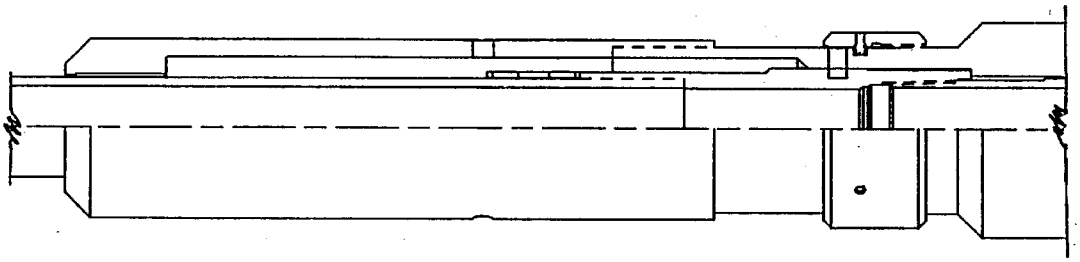
Figure 21:
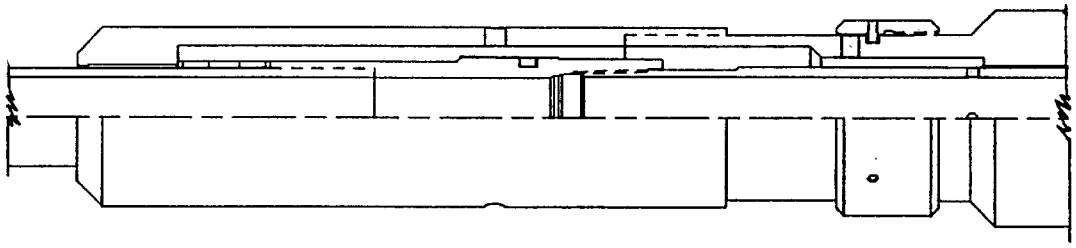
Figure 8:
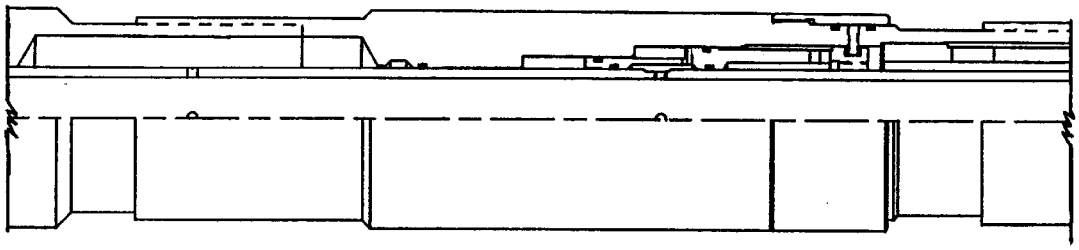
Figure 14:
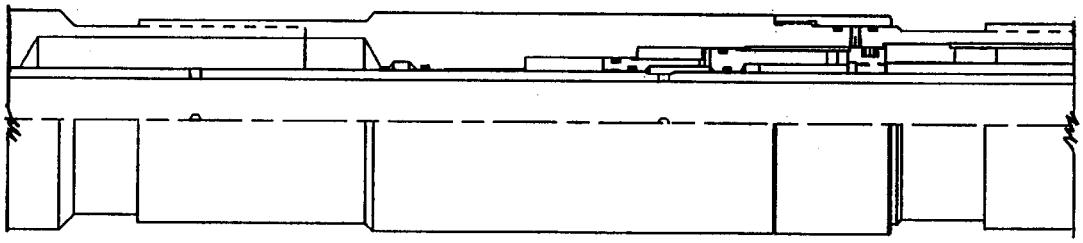
Figure 18:
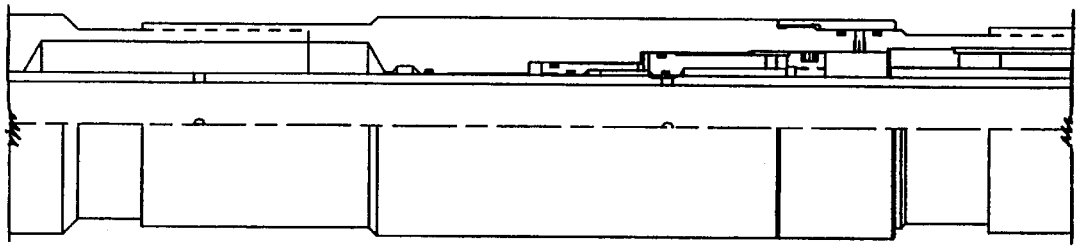
Figure 22:
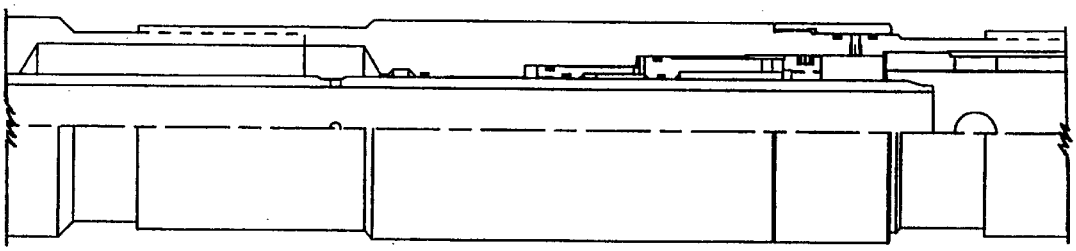
Figure 9:
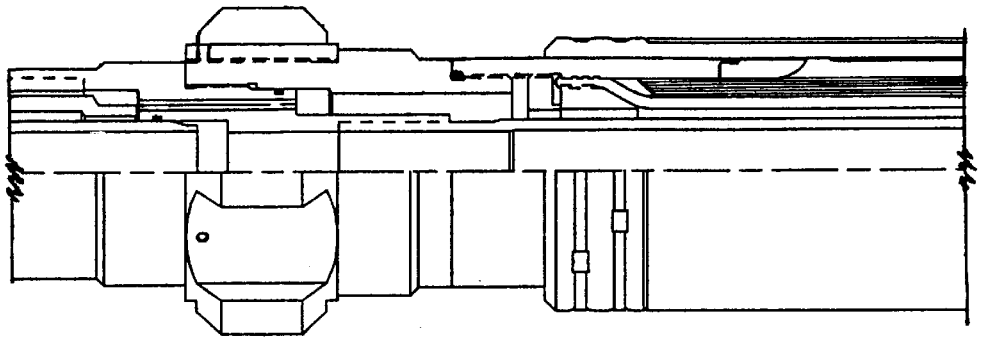
Figure 15:
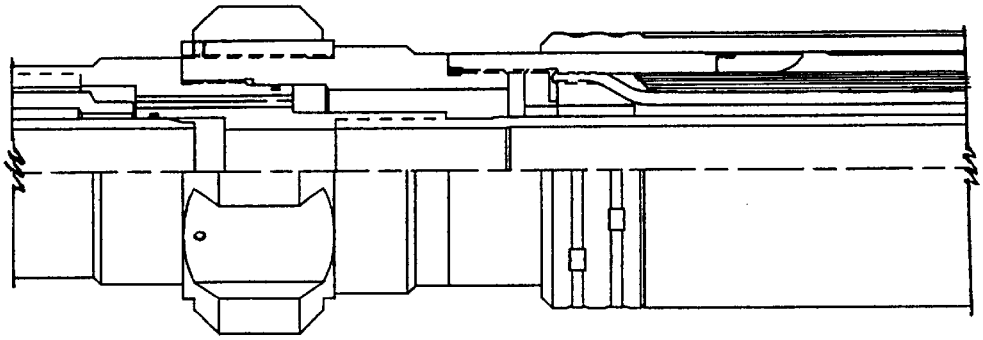
Figure 19:
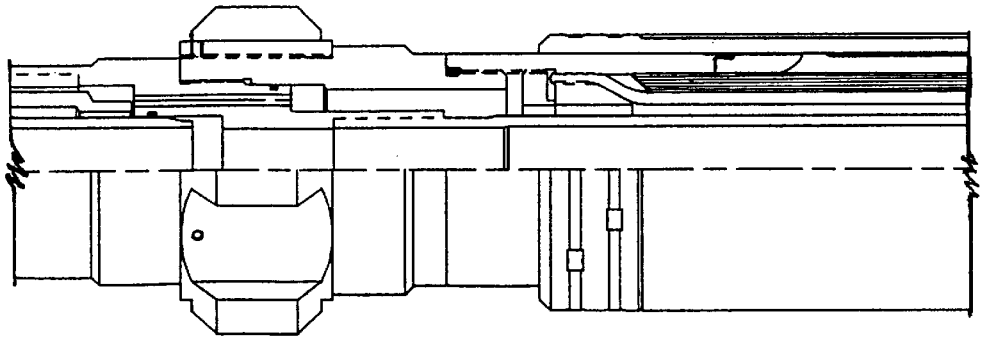
Figure 23:
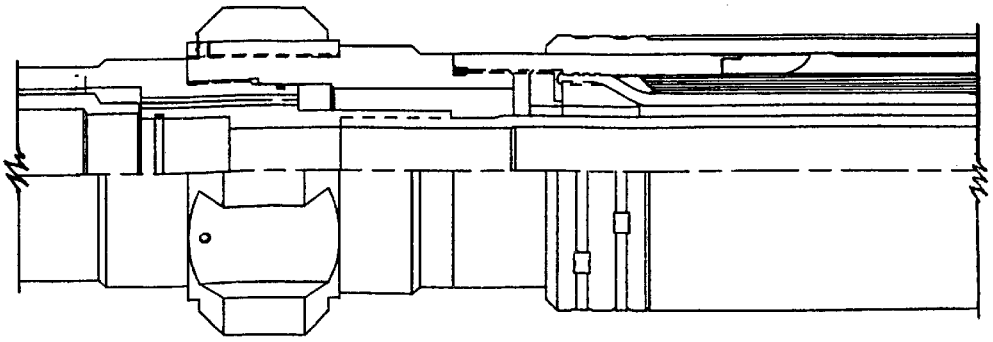
Figure 10:
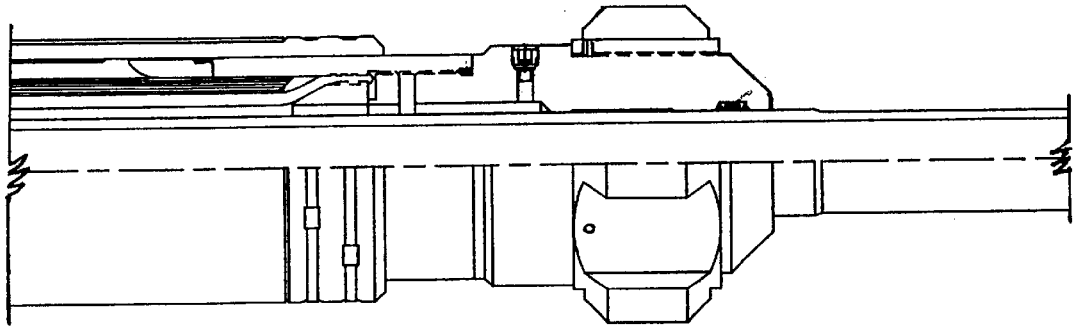
Figure 11:
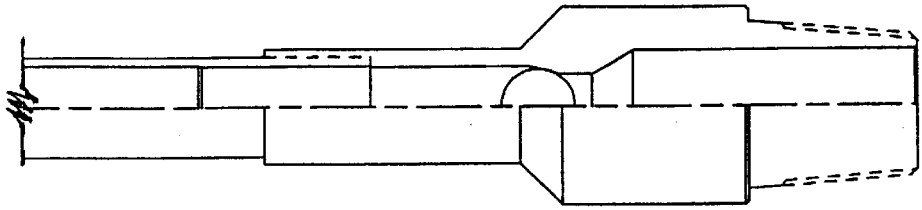
Figure 24:
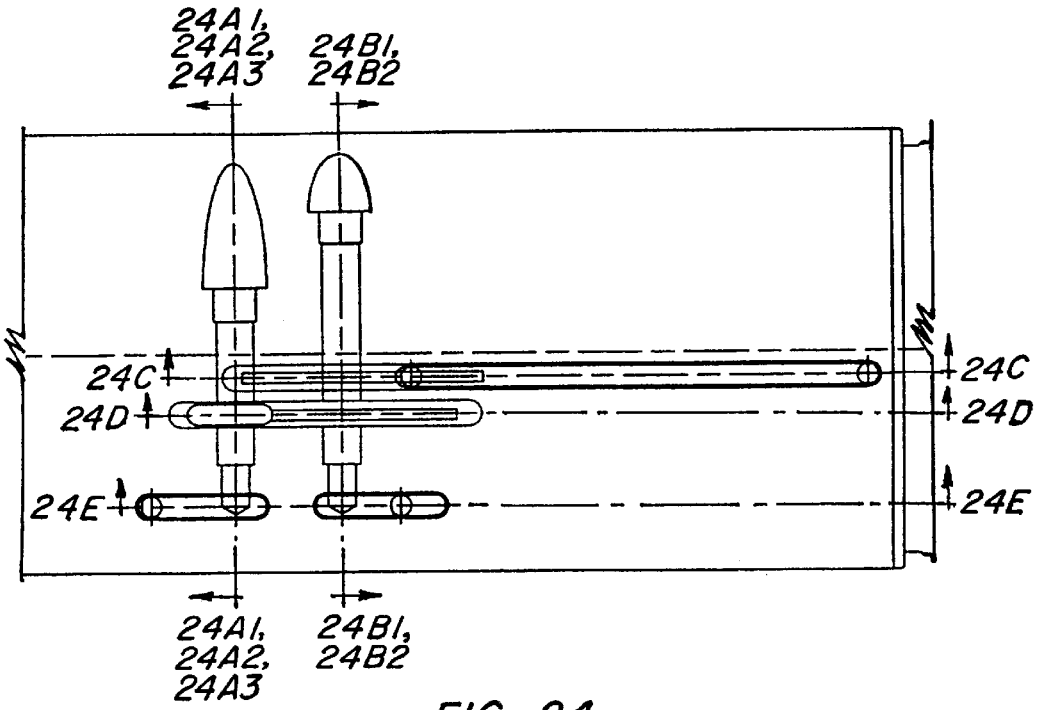
FIG. 24 is an enlarged view of the valve of the invention.
Figure 24C:
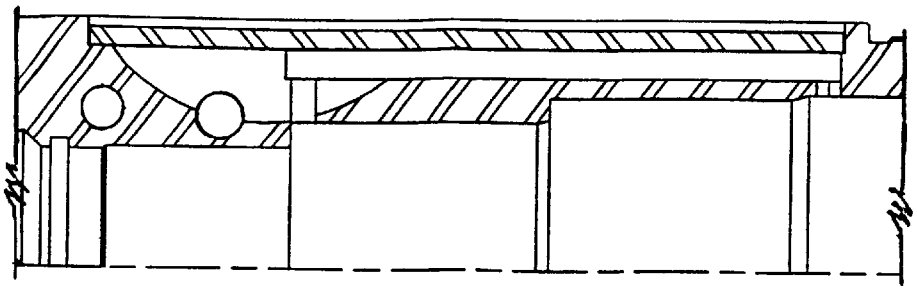
FIG. 24C is a cross sectional view taken along section line C—C in FIG. 24.
Figure 24D:
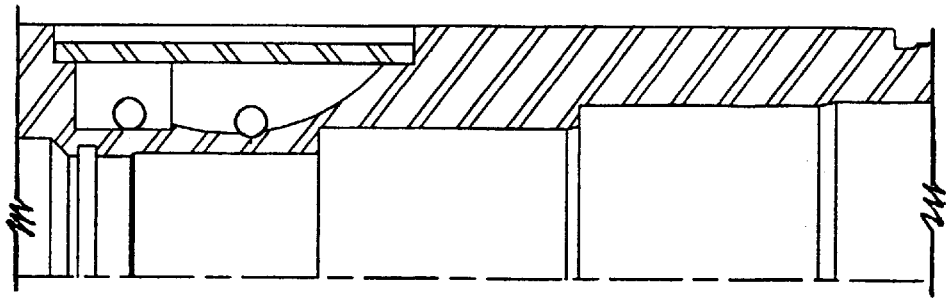
FIG. 24D is a cross sectional view taken along section line D—D in FIG. 24.
Figure 24E:
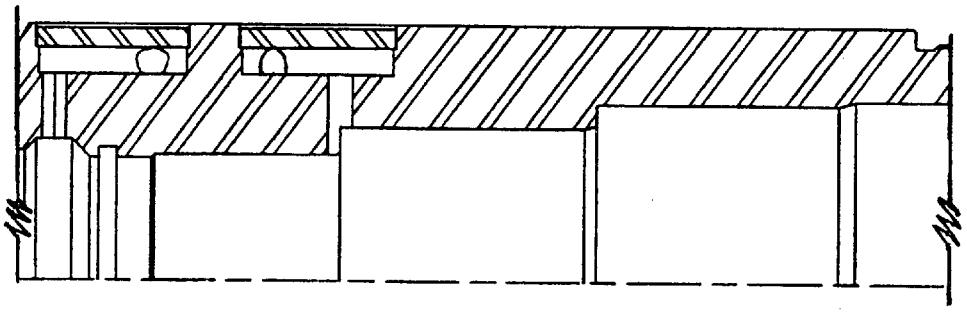
FIG. 24E is a cross sectional view taken along section line E—E in FIG. 24.

Referring to FIG. 5, a guide stock 40 is illustrated in a position properly oriented to the lateral borehole 20. The guide stock 40 is made up to align with window 28 exactly by adjusting the orientation of the guide stock 40 on the orientation sub 42 and providing any spacers necessary to properly place the guide stock. The setting of the original whipstock 14 has thus been adjusted to meet the alignment requirements of borehole 20 occasioned by the forces of drilling on whipstock 14 as discussed previously. All measurements are provided accurately by impression 32 to perfectly align guide stock 40 with borehole 20 when guide stock 40 is stabbed in packer 12.

Preferably the impression packer 22 is long enough to provide an impression surface that will cover the entire window 28 with one impression. It is possible, however, to employ more than one impression packer for different areas of the window. By changing the length of space-out subs on the impression packer, different areas of the window may be queried. All of the impressions can then be recombined at the surface by measurement of distance from the packer 12 which is known. A single packer 22 long enough to cover the window is preferable due to a shorter period of time necessary to obtain the whole impression, less calculation work and fewer opportunities for error with a single impression.

With respect to the impression packer itself, referring to FIGS. 6 through 25, two embodiments of the invention are illustrated. In the discussion above, possible difficulties with conventional impression packers were noted such as problems associated with inflation and deflation. Another possible problem while employing conventional impression packers in the method of the invention is an over pressure situation. Keeping in mind the low pressures at which the method of the invention is effective, as set forth above, one of skill in the art will readily recognize the potential for an over pressurization situation where the element may rupture or other damage could occur. Over pressurization may be exacerbated by a long fluid column above the device which makes accurate pressurization difficult. Thus the invention discloses two embodiments of impression packers which reduce or avoid any over pressurization potential.

In a first embodiment; illustrated in FIGS. 6–24E, a conventional impression packer is modified by the addition of a pressure sensitive valve. The valve is intended to close at the time the pressure of fluid internal to the impression packer is at or about 200 psi. Once the valve is closed fluid pressure from the column, or ultimately the surface, will not be added to the interior of the packer. With this safety feature, over pressurization concomitant a surface fed system is unlikely. The valve is preferably mechanically actuated by providing a port open to internal element pressure and to a closure valve assembly whereby internal element pressure upon overcoming the bias of a spring closes the valve. This is designed to occur at about 200 psi. It should be noted that the valve may also be electromechanically or electrically actuated and may be associated with downhole sensor(s) and a processor of other type or controller.

Figure 25:
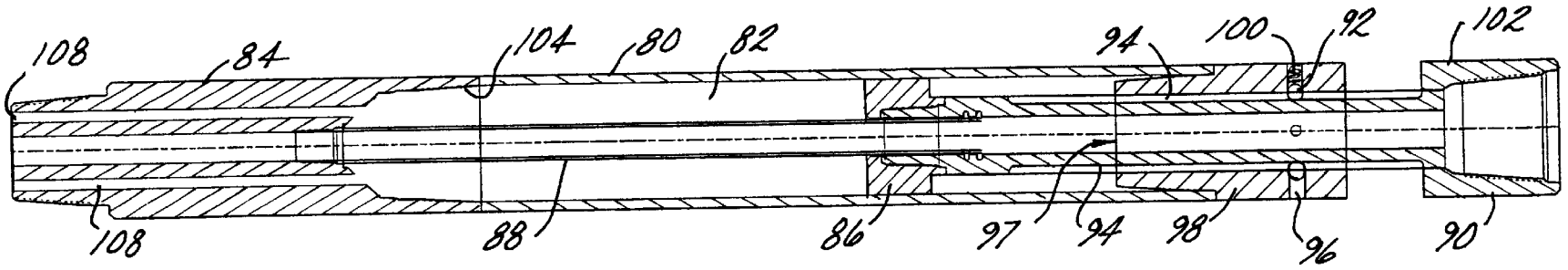
FIG. 25 is a cross sectional view of the self-inflating sub for an impression packer.

In a second embodiment of the impression packer of the invention, reference being made to FIG. 25, over pressurization is virtually impossible due to the inflation fluid being carried within an inflation tool connected to the impression packer itself. Set down weight on the packer causes shearing of a retaining member whereafter the set down weight forces fluid out of a reservoir and into the element. The amount of fluid contained in the reservoir is sufficient only to create an internal pressure within the impression packer of about 200 psi. Picking up on the device creates an opposite reaction and draws fluid back into the reservoir thus deflating the element.

In FIG. 25, the reservoir is identified by numeral 82. Reservoir 82 is bounded by housing 80 circumferentially, inflation sub 84 at the downhole end threaded into housing 80, piston 86 at the uphole end, fluid sealingly slideable within housing 80 and washover pipe 88 centrally. As is then apparent, reservoir 82 is annular. Piston 86 is slidable within housing 80 to either expel fluid from the reservoir or draw fluid back in similar to a hypodermic needle. Piston 86 is operated through movement of mandrel 90 which is coaxially located within housing 80. Mandrel 90 is supported radially, preferably by a plurality of torque bearings 92 arranged circumferentially therearound although it should be understood that other support structure could be substituted. The torque bearings number preferably six, but more or fewer may be employed if desired. Torque bearings 92 ride in semicircular grooves 94 in mandrel 90 and are maintained in contact with mandrel 90 by being held into holes 96 in top sub 98 with set screws 100. Mandrel 90 terminates at the uphole end thereof preferably with a box thread connector 102 for connection a to tubing string (not shown). It should be noted that the stroke of piston 86 is preferably from top sub contact face 97 to the uphole end of pin thread 104 where housing 80 connects to inflation sub 84.

During run in, reservoir 82 is filled with an amount of fluid appropriate to fill the selected size of the impression packer to about 200 psi and to the predetermined circumference (equal to the hole in which the packer will be inflated). Mandrel 90 is prevented from moving piston 86 during run in by a shearable connection. The connection is preferably at least two shear screws 106. Upon set down, however, of the orientation sub for the impression packer, screws 106 are sheared and the fluid in reservoir 82 is urged through the several inflation ports 108 by piston 86 due to downward movement of mandrel 90. When the piston 86 has fully stroked, the fluid displaced from reservoir 82 into the impression packer is the quantity of fluid that will create about 200 psi in the packer. The movement is caused by additional set down weight from the tubing string above. The fluid is expelled from reservoir 82 through inflation ports 108 and into the impression packer connected to the self-inflating device of the invention. The inflation ports 108 are preferably drill holes through inflation sub 84. Preferably at least two are provided. Inflation ports 108 remain in open fluid communication with the inflatable element of the impression packer. This is important because it provides for automatic deflation of the packer as well as inflation. More specifically, upon picking up on mandrel 90, piston 86 moves uphole and creates a vacuum within reservoir 82 which draws fluid out of the impression packer causing it to deflate. By the time the pick up force reaches the 30–40 thousand pounds to disengage the orientation subs on the impression packer, the mandrel 90 is in its fully extended position, piston 86 has been stroked fully uphole within the tool and all of the fluid in the inflatable element has been removed. The tool then can be easily tripped out of the wellbore for examination as discussed hereinabove.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for determining the orientation of a window in a wellbore comprising:

inflating an impression packer at a surface location to a circumference substantially matching an inside diameter of the wellbore at a predetermined setting location and scribing a reference line thereon;

running said impression packer into said wellbore and mating with a preinstalled packer; having a known orientation to orient said impression packer;

inflating said impression packer in said wellbore by dependent inflation from an on-board reservoir upon a predetermined force and taking an impression of the window in said wellbore;

deflating said impression packer by flowing fluid back into said reservoir and removing said impression packer from the wellbore;

reinflating said impression packer at a surface location to the circumference substantially matching the inside diameter of the wellbore; and measuring said impression relative to said reference line and determining therefrom the orientation and location of the window.

2. A method for determining the orientation of a window in a wellbore as claimed in claim 1 wherein said inflating said impression packer in said wellbore comprises inflating to a pressure in the range of about 100 to about 300 psi and holding said pressure for a predetermined amount of time.

3. A method for determining the orientation of a window in a wellbore as claimed in claim 2 wherein said pressure is about 200 psi.

4. A method for determining the orientation of a window in a wellbore as claimed in claim 1 wherein said method further includes providing for re-entry to said window by constructing a guidestock with an orientation sub to align with said window and installing said guidestock in said wellbore.

5. A method for determining the orientation of a window in a wellbore as claimed in claim 1 wherein said measuring includes determining distance from said pre-installed packer, orientation relative to said pre-installed packer and profile of said window.

6. A method for determining the orientation of a window in a wellbore as claimed in claim 1 wherein said inflating of said impression packer is automatic upon application of said predetermined force.

* * * * *